United States Patent [19]

Kaffko

[11] Patent Number: 4,655,358

[45] Date of Patent: Apr. 7, 1987

[54] BOTTOM PROFILE

[75] Inventor: Leslie K. Kaffko, Cary, Ill.

[73] Assignee: American Can Company, Greenwich, Conn.

[21] Appl. No.: 242,325

[22] Filed: Mar. 10, 1981

[51] Int. Cl.[4] ..... B65D 7/42

[52] U.S. Cl. ..... 220/66; 206/509

[58] Field of Search ..... 220/66, 67; 206/508, 206/509

[56] References Cited

U.S. PATENT DOCUMENTS

| | | | |
|---|---|---|---|
| 3,105,765 | 10/1963 | Creegan | 220/66 |
| 3,638,825 | 2/1972 | Franek et al. | 220/66 |
| 3,814,279 | 6/1974 | Rayzal | 220/67 |
| 3,878,963 | 4/1975 | Knize | 220/66 |
| 3,907,152 | 9/1975 | Wessely | 220/66 |

*Primary Examiner*—Stephen Marcus
*Assistant Examiner*—David Voorhees
*Attorney, Agent, or Firm*—Paul R. Audet; Warren N. Low

[57] ABSTRACT

This disclosure relates to the bottom profile on a one gallon metal paint can and more particularly to the specific concentric circular re-enforcing bends and beads applied to profile the bottom. In order to increase the static and dynamic strength of the bottom, the selection and position of re-enforcement is essential to maximize resistance to dynamic loadings and static load.

7 Claims, 1 Drawing Figure

BOTTOM PROFILE

BACKGROUND OF THE DISCLOSURE

This invention is concerned with the design and manufacture of paint can bottoms. Paint cans are over 6½" in diameter for the popular one gallon size and the can body is made from a flat blank of sheet metal rolled into a cylinder and joined along the meeting longitudinal edge. This rolled cylindrical body is conventional throughout the industry and is manufactured from tinplate. To the body is doubleseamed a circular bottom closure and a top ring designed to receive the top closure or plug.

The present disclosure is concerned with the design and manufacture of a bottom end closure which has greater resistance to creasing and fracturing from fatique stress. The standard size 610×703 height diameter one gallon paint can is filled with 10 to 13 pounds of paint and tends to be abused in normal packing and shipping. The can makers convention gives the diameter across the completed doubleseam in inches plus sixteenths of an inch then the height in inches plus sixteenths of an inch. Therefore, the foregoing container is 6 10/16" in diameter by 7 8/16" in height.

More particularly, if a paint container is dropped and/or bumped, it is expected that the bottom end closure will suffer the greatest deformation. The bottom end closure buckles or creases radially across the transition between the various areas of the profile. These transitions are usually circular and concentrically located and consist of little more than a series of radii representing and defining re-enforced areas which act to prevent the bottom from flexing or warping. It should be appreciated that paint cans suffer greater stresses than other cans of similar design because of their larger size and the heavier weight of the contents in them. One easy solution to overcoming dynamic and static loadings is to increase the thickness of material from which the container bottom end closure is made. That is an unacceptable approach in that more material, more energy and more cost for manufacture and shipping are incurred with that solution. Another approach which has some potential for minimizing the thickness of the container bottom end closure would be to use higher strength materials and maintain the lighter gauge. This solution is normally unacceptable in and of itself because higher strength materials tend to have less fatique resistance because of their minimal ductility.

It has been found that the balance between maximum static strength and dynamic strength resides in the overall configuration of profile applied to the bottom. This configuration or profile is critical to achieving an overall efficient combination of plate weight, plate type and dynamic and static strength.

OBJECTS OF THE DISCLOSURE

It is an object of the present disclosure to define a bottom re-enforcing profile for a paint can for maximizing the strength and minimizing the material requirements.

It is yet another object of the present disclosure to teach a means by which the dynamic or fatique strength of the paint can bottom closure can be maximized.

It is still a further object of the present disclosure to suggest a means for producing a low cost, reliable and materially efficient one gallon paint can bottom.

SUMMARY OF THE DISCLOSURE

In accordance with the foregoing objects and in an effort to produce a superior one gallon paint can bottom closure, a research effort was undertaken to produce a closure which was tested mathematically and mechanically. Both tests proved that the can bottom of the present disclosure is superior in dynamic and static strength parameters even though it is constructed of light gauge, higher strength (i.e. harder) metal. In the past, can bottoms have been manufactured from 85 to 100# base box, base weight. The base box terminology for base weight is standard in the can making industry; it originally referred to the amount of steel in a base box of tinplate consisting of 112 sheets of steel 14" by 20", or 31,360 square inches plate. Today the base box as related to base weight refers to the amount of steel in 31,360 square inches of steel, whether in the form of coil or cut sheets. These bottom end closures had a variety of profile configurations none of which were identical to that of the present disclosure. In addition to the foregoing, the prior container bottoms had varied performance during testing under a flexing load. The dynamic fatique resistance of the bottom closure of the present disclosure was found to be 3 to 4 times better in terms of test-life than the next best competitive design of any plate weight when this particular test was run. More specifically, a test on a fixture which flexes the bottom more severely than any paint can would flex in service could not be made to fail. That container was made from 85#. DR9 is a tin mill product specification that relates to the process by which the metal is cold reduced (i.e., DR -Double Reduced) in two stages with an anneal preformed between the two cold rolling operations. The steel is reduced approximately 89% in the first reduction, is annealed, and then is reduced about 25 to 40% in the second and final cold reduction.

With the preferred profile and 85# DR9 tinplate, the overall buckle strength is also superior in that such a container end will resist an internal load of 10–11½ psi before radial creases appear which are designated as a buckle. Although such buckle strength is comparable to presently available plate weights and materials and has been found to be adequate for the performance requirements of a one gallon paint can, the improvement sought and developed was to maintain buckle strength and increase fatique strength.

More particularly, the normal criteria for a paint can bottom end design had been buckle strength. That consideration presumes the strength of the end to be sufficient as long as the end does not suffer an abuse during the handling or shipping. Abuse being defined as a blow which would be abnormal and deform the container due to its impact having been significantly greater than normal. That sole criteria for buckle strength does not completely consider the true loadings applied to a larger diameter can end. That is to say that, the cyclic loading which leads to fatique failure is not normally considered. Fatique failure of a paint can bottom results from vibrational loadings e.g., transit, by truck or train shipment or from some paint can mixing shakers. Of course, once the bottom end has been slightly damaged fatique failure is more likely to occur along a crease or buckle line established by the damage.

By means of finite element computer analysis (which divides the cross-sectional structure of the bottom closure into a series of pieces adjacent to one another and considers the relative stiffness of each piece with respect to its adjacent piece by means of mathematical computer analysis), the stress in any given piece or location of the structure can be determined. Such an approach was used to isolate the areas of severe or critical stress in existing designs. Once the problem areas were located appropriate corrections had to be found and incorporated in a new design. The new design was then tested by finite element computer analysis to determine if the suggested corrections were best. The ultimate corrections as applied are the subject of the present disclosure. More specifically, the free span (unformed center section) of the paint can bottom was reduced. The transition section between the center free span and the next adjacent re-enforcing section was softened by means of a milder slope. The next adjacent section (radially outward of the transition section) is composed of two portions; the first is flat or normal to the axis of the can body and about one-third of the total area and the second is sloped toward the base of the countersink bead and is about two-thirds of the total area.

DETAILED DESCRIPTION OF THE DISCLOSURE

Figure 1:
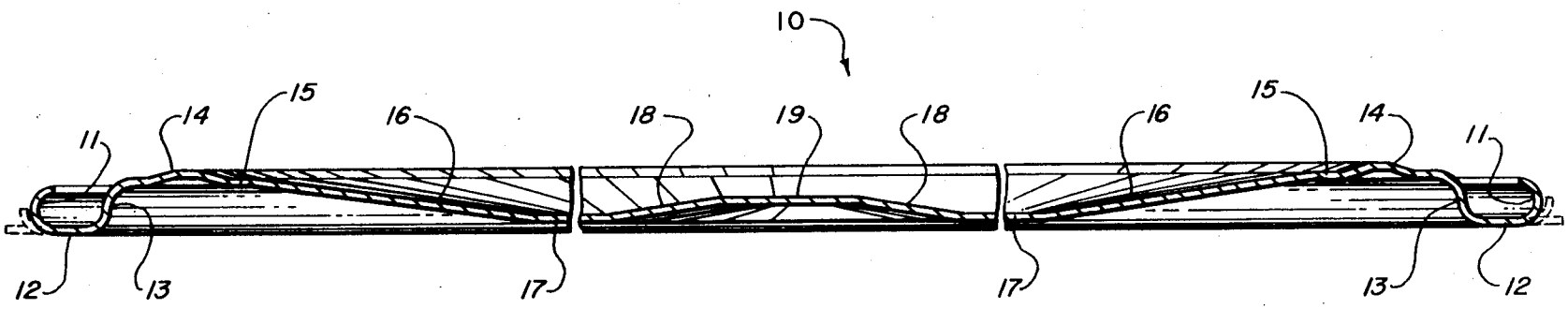
FIG. 1 is a side cross-sectional view of the bottom profile for a paint can of the present disclosure.

Bottom closures such as the present invention, have introduced into their design (profile) panels and radii, for the purpose of adding rigidity and strength. These abrupt variations cause stress concentrations, a condition where within a very short distance the intensity of stress increases greatly. The 610 bottom closure is made from a ductile metal. In ductile metals, a marked plastic deformation commences at a fairly definite stress (yield point, yield strength, possibly elastic limit). A ductile metal is usually considered to have failed when it has suffered elastic failure, i.e., when marked plastic deformation has begin.

Practically all materials will break under numerous repetitions of a stress less than that required to produce immediate rupture. This phenomenon is known as fatique, which causes a crack to develop and spread, first gradually, then rapidly, until fracture occurs.

The present invention is designed such that the stress levels, especially in areas of stress concentration, have been minimized. This aids in minimizing, or eliminating the occurrence of creases (buckles) in abusive handling, and the incidence of fracturing from fatique loading, to which all paint cans are subjected.

Turning now to the drawing in FIG. 1, and, in particular, the cross-sectional showing of a paint can bottom profile as same would appear before it is seamed on to the rolled body of a paint container. It will be noted that the bottom 10 is positioned as it would be with respect to a can. That is to say that, it faces upwardly in the area of the cover hook 11, as such would be the disposition of it before it meets the paint container body flange (not shown) for double seaming. The bottom 10 is circular in shape and has a series of concentrically disposed (about an axis or center line A, shown in phantom) sections which define its overall profile. Each of the respective concentrically disposed sections is such that the complete bottom represents a series of rings or annular portions about the circular center panel of the container. Working inwardly from the cover hook 11 there is a flat range area 12 which extends radially inward to an upturned countersink wall and adjacent groove 13. These features of the bottom 10 are identical to those of the prior art and those of earlier containers. The next adjacent area inwardly of the countersink groove 13 is a flat section extending to an inwardly disposed bead both labelled generally 14. The inwardly disposed bead 14 countersink and cover hook 13 areas represent about 16% of the total area of the container bottom 10. Inwardly radially and adjacent to the foregoing 16% area is a small transition section which angles downwardly very slightly having little or no apparent angularity with respect to a plane normal to the axis A and in the sense that the bottom 10 would be applied to the container. The transition section 15 is about 5 to 6% of the overall bottom area. It cooperates with the next adjacent section called an outer sloped section 16. The outer sloped section 16 continues in the same direction as transition section 15 but at a greater angle. Outer sloped section 16 acts much like a leaf spring when the bottom 10 is flexing under a dynamic fatique loading.

The combination of section 16 and transition 15 coact to provide flexibility and stiffness respectively. That is to say that, section 16 takes the majority of the flexing and the small stiffer transition section 15 acts to provide a more rigid or flex resistant portion between section 16 and the outer bead 14. The reason this is so is because the outer sloped section 16 has an area of about 30 to 40% of the overall area of the bottom. In the preferred embodiment the area is about 35%. That large free span of gently sloped material has been found to provide the requisite flexibility to enhance fatique resistance. The sloped area is angled outwardly relative to the inside of the paint can when viewed from the perspective of being higher at its connection point with the transition 15 and lower at its radially inwardly most portion.

The radially inwardly most portion of the outer sloped section 16 is connected to a flat washer-like section 17 having a percentage area about one-half of the area of the outer sloped section 16. Flat section 17 is provided to act as an inner connecting means between the outer sloped section 16 and an inner sloped section 18. More specifically, where outer sloped section 16 angles outwardly with respect to the axis A of the paint can the inner sloped section 18 angles inwardly from its radial outwardly portion to its radially inward portion with respect to the container axis A. This inner sloped section 18 is about the same relative inclination with respect to flat section 17 as that of the outer sloped section 16. Those angles are in the range of about 5° to 15° depending on the overall diameter of the container. In the preferred embodiment that angle is 7°–10°. The overall area percentage-wise of the inner sloped section 18 is about one-fourth of that of the outer sloped section 16 and so the inward axial depth (height up into the can) of the inward radial portion of section 18 is less than the inward axial depth (height up into the can) of the outward radial portion of section 16.

Connected to the inner sloped section 18 and being next adjacent thereto and radially thereof is a circular center panel 19 which is flat and in a plane perpendicular relative to the axis A of the paint can. This center panel 19 has an area about equal to that of flat section 17. Center panel 19 completes the profile of paint container bottom 10. To the extent that center panel 19 is flat and in a plane normal to the axis A, it is planar. During flexure of the bottom 10 the center panel 19 moves in planes normal to the axis A as the flexing is primarily in the outer sloped section 16.

PREFERRED EMBODIMENT DIMENSIONS FOR A 610 DIAMETER PAINT CAN BOTTOM PROFILE

| | OUTER DIAMETER | % OF TOTAL AREA |
|---|---|---|
| CENTER PANEL | 2.60" | 16.28% |
| INNER SLOPED SECTION | 3.17" | 7.86% |
| FLAT SECTION | 4.23" | 18.88% |
| OUTER SLOPED SECTION | 5.71" | 35.35% |
| TRANSITION SECTION | 5.91" | 5.56% |
| BEAD AND COUNTERSINK | 6.45" | 16.07% |

It will be noted that the cover hook and flat flange adjacent thereto are not figured in the above calculations because after double seaming onto a paint can body that area is moved radically inward. Similarly, the angle between the inner sloped section or the outer sloped section and the plane of the flat section is about 8° to 10°.

In general, the overall flexibility and resistance to fatique stress of bottom 10 has been enhanced by a combination of the size and position of the various sections of the container bottom. It has been found necessary to have the outer sloped section 16 disposed such that it can permit the necessary flexing and to have it large enough to be dynamically worked without fatique. It is also important that this large outer sloped section 16 be located radially outward of the center panel 19. Flexing of only a large center panel is unsuitable in that it stresses the smaller radially outwardly adjacent areas. Similarly, it is critical that the sections that connect with outer sloped section 16 be designed to cooperate with the overall idea of section 16 being primarily the flexible area. Thus, the transition 15 and the flat section 17 are included and kept with minimal angularity relative to section 16 to provide somewhat greater stiffness without a concentration of stress at their respective junctures.

It is, therefore, the purpose of the claims which follow to cover any container bottom which has the overall general configurational shape and, more specifically, concentric sections designed to flex and thus carry dynamic loadings applied to such container bottoms. More specifically, the countersink and cover hook areas have to be rigid as does the outer bead area relative to the overall flexibility of the bottom 10. The center panel 19 must operate in such a fashion that it can move axially inwardly and outwardly without significant change in cross-sectional configuration flexure. It is necessary that the annular or ring sections between the center panel 19 and the outer radial most sections or rim of the bottom will act as spring members to permit the overall flexing of the bottom. The spring portions of these sections have to be tempered with connecting junctures that tend to damp the springing near the connections to the more relatively rigid portions of the bottom. Therefore, the claims which follow seek to cover the aforesaid concepts in their broadest context without regard to the specific material or the actual dimensions necessary for a particular embodiment.

What is claimed is:

1. A bottom end closure for a thin wall hollow tubular cylindrical container body such as for containing paint wherein said end closure being formed from a thin disc of metal and adapted to be double seamed to said body and having a series of sections concentrically positioned relative to the center of said disc formed into said closure, disposed radially relative to each other and extending from a planar center panel to a countersink groove associated with a cover hook being that portion of said end for double seaming to the body when the axis of same is aligned with said center and wherein the profile defined by said sections being the improvement to enhance resistance to dynamic loadings caused by flexure of said end closure comprising:

a countersink groove positioned radially inwardly of the cover hook for double seaming, a bead facing and opening outward of said body and positioned inwardly of said countersink groove for acting to resist flexure by increasing stiffness of the area thereabout;

a transition section located radially inwardly of said bead and being connected thereto and having a sloped inclination outwardly of said body and with an area of 5 to 6 percent of said double seamed end;

an outer sloped section of said end located radially inwardly of said transition section sloped with a uniform frusto conical surface configuration extending toward the axis of said body yet angled outwardly of the interior thereof and more so than said transition section and having an area of about 30 to 40 percent thereof when double seamed, a flat washer-like section located radially inwardly of said outer sloped section and carried in a plane normal to the body axis with an angularity relative to said outer sloped section in the range of about 5° to 15° and having an area of about one-half the area thereof wherein the portions of said end which thus bound said outer sloped section have greater stiffness and are connected thereto with minimal angularity encouraging flexure across said outer sloped section, and;

a center panel of said end connected to said flat washer-like section for movement of said center panel through planes perpendicular to the axis of said body thereby controlling the dynamic response of said end closure.

2. The end closure of claim 1 wherein the boundary of the innermost radial portion of said outer sloped section is circular and connects to said flat washer-like section which lies in a plane substantially normal to said axis of said body and the boundary of the innermost radial portion of said washer-like section is circular and connects to an inner sloped section being an upward inwardly frusto conically shaped surface which extends to the outer radial circumference of said circular center panel.

3. The end closure of claim 2 wherein said frusto conically disposed sections intersect with said ring shaped section at angles of 7° to 10° relative to said plane thereof.

4. The end closure of claim to 3 wherein said circular center panel is planar and about one-half the total area of said outer sloped section.

5. The end closure of claim 4 wherein said washer-like section is about equal the area of said center panel.

6. The end closure of claim 5 wherein said inner sloped section is about one-half the area of said center panel.

7. The end closure of claim 6 wherein said transition section is about one-third the total area of said center panel.

* * * * *